US010252408B2

(12) United States Patent
Hughes

(10) Patent No.: US 10,252,408 B2
(45) Date of Patent: Apr. 9, 2019

(54) STAPLE REMOVER

(71) Applicant: Alan James Hughes, Bucknell (GB)

(72) Inventor: Alan James Hughes, Bucknell (GB)

( * ) Notice: Subject to any disclaimer, the term of this patent is extended or adjusted under 35 U.S.C. 154(b) by 2 days.

(21) Appl. No.: 15/664,195

(22) Filed: Jul. 31, 2017

(65) Prior Publication Data

US 2018/0029212 A1 Feb. 1, 2018

(30) Foreign Application Priority Data

Jul. 29, 2016 (EP) ..... 16182040

(51) Int. Cl.
*B25C 3/00* (2006.01)
*B25C 11/00* (2006.01)
*E04H 17/26* (2006.01)

(52) U.S. Cl.
CPC ..... *B25C 11/00* (2013.01); *E04H 17/268* (2013.01)

(58) Field of Classification Search
CPC ..... B25B 7/00; B25B 1/00; B25B 3/00; B66F 15/00; B66F 11/00; B25C 3/00; B25C 5/00
See application file for complete search history.

(56) References Cited

U.S. PATENT DOCUMENTS 3,952,384 A * 4/1976 Goldry ..... B25B 5/147 294/201
4,293,121 A * 10/1981 Wallin ..... B66D 1/7415 254/217
5,253,844 A * 10/1993 Cotic ..... B25B 31/00 254/131
5,996,969 A * 12/1999 Johnston ..... B25C 11/00 254/28
6,113,073 A * 9/2000 Lefavour ..... E01B 29/26 254/18
7,090,198 B1 * 8/2006 Gurmu ..... B25C 11/02 254/28
2004/0262586 A1 * 12/2004 Moscone ..... B25C 11/02 254/28
2009/0267034 A1 * 10/2009 Marks ..... B25C 11/02 254/28
2015/0101167 A1 * 4/2015 Jiang ..... B25C 11/02 29/426.5
2018/0029212 A1 * 2/2018 Hughes ..... E04H 17/268

* cited by examiner

*Primary Examiner* — Lee D Wilson
(74) *Attorney, Agent, or Firm* — King & Schickli, PLLC

(57) ABSTRACT

A staple removal device for removing a staple and wire arrangement from a fence post includes a main body having a first jaw and a second jaw spaced apart from each other. The first jaw and second jaw provide a first and second elongate channel respectively for receiving the wire. Both the first and second elongate channels comprise a closed end in which the wire may be received. A gripping portion is moveably connected to the main body and a lever causes movement of the gripping portion. Beneficially, a first and second block portion is configured at a surface of the main body wherein a side edge of the first and second block portion is substantially in alignment with the closed end of the first and second channel respectively so as to, in use, increase the surface area of the contact region between the staple removal device and the wire.

15 Claims, 6 Drawing Sheets

STAPLE REMOVER

This application claims priority to European Patent Application No. EP16182040.2 filed Jul. 29, 2016.

FIELD OF INVENTION

This invention relates to a staple remover, in particular a staple remover to remove fencing staples and wires from wooden fence posts.

BACKGROUND

It is known to use agricultural fencing for a wide range of purposes, for example to contain livestock, for defining land boundaries and for fencing off waterways.

A common type of agricultural fence is post and wire fencing. Such fences are built in sections whereby the farmer marks out the desired line of the fence and then places wooden strainer posts at each corner of the fence line. The strainer posts are larger, longer and heavier than other posts and have to stay in place when the fence wires are tightened or "strained". Strainer posts are usually supported by stays, which are wooden posts that lean on an angle against the strainer post, in each direction that the fence line runs. This arrangement prevents the strainer post from being pulled over when the lines are tightened. Intermediate straining posts are also inserted into the ground between the corner posts. These are generally smaller that the strainer posts and are spaced at regular 2.5 to 3 meter intervals. It is usual for four to six strands of wire to be used in the fence. The wires are attached to the intermediate posts so as to prevent the escape of livestock. Attachment of the wire to the intermediate posts is by means of fencing staples. Fencing staples are U-shaped nails, with a barbed structure at each end. The barb has the appearance of an arrow head facing backwards from the direction of insertion of the staple. The barb digs into the post and as a result makes it harder to remove from the post by adding to the drag of the staple. When the staple is inserted into the post properly, the full length of the staple leg is inserted into the post. A large number of the fencing staples are required to adequately secure all of the fence wires to each post and batten.

It is often necessary to remove fence posts from the fence wire/wires and/or the fence as a whole. One reason for doing this is if the fence posts become damaged, e.g. through general wear over time, or if they become damaged as a result of contact with cattle. It may also be necessary to remove the wire(s) need to be removed or replaced or to replace the fence itself.

More often than not, all of the intermediate posts will be replaced at the same time to ensure that the fence posts are all of the same age and quality.

Since a large number of staples and wires are provided it follows that the removal of existing staples from the wire and intermediate posts of a fence can be a substantial undertaking, both in time and effort. Therefore it can be an extremely time consuming and fiddly process.

It is known to use fencing pliers to remove staples and/or wires from fence posts and battens. These pliers have jaws which pinch into the top of the staple in a vice like manner, after which the staple is levered out, utilising the curved nature of the head of the pliers, thus freeing the wire from the fence post.

However a disadvantage associated with the use of fencing pliers is that they often end up breaking the top of the staple, after which the broken parts of the staple have to be removed with conventional pliers. Furthermore, many staples are hammered well into the surface of the post, and in such instances not enough of the staple is protruding to allow the jaws of the fencing pliers to grip the staple. Moreover, the use of fencing pliers for staple removal can be a fiddly, awkward, and time-consuming operation, and especially so when removing staples/wires from fence battens, which are prone to moving about during the operation of removing the staple.

Another tool which is sometimes used for removing staples/wires from fence posts is a claw hammer. The claw of the hammer is forced behind the wire or the staple and the staple is subsequently levered out of the post (similar to how a claw hammer levers out a nail). However, it is sometimes difficult to force the claw of the hammer behind the wire of the staple. Furthermore, a claw hammer is ineffective in situations where the wire is loosely broken. Moreover the use of a claw hammer is ineffective in situations where the wire is loose or broken. Moreover, the use of a claw hammer for staple/wire removal can be a fiddly, awkward, and time-consuming operation, and especially so when removing staples/wires from fence battens, which are prone to moving about during the operation of removing the staple/wire.

A staple remover as shown in FIG. 1 is known in New Zealand that uses at least two claws for holding onto the wire each side of a staple, where each of the claws includes a slot in which the wire is located and/or retained. A leverage portion is provided to abut a front surface of the fence post. A wire gripping means is rotatable about a pivot point using a lever. Initial actuation of the lever causes the wire gripping means to rotate about the pivot point and grip the wire within each slot of the claws. Secondary activation of the lever causes the staple remover to pivot about the leverage portion, thereby leveraging the staple and wire from the fence post. However, the known staple remover can only pull out staples of a certain size for example small staples under 15 mm long which are generally applied to square posts, commonly used in New Zealand. In the UK however, posts are not necessarily square and instead they may be round or half round. This requires the use of staples that are longer in length and generally larger than the staples used in New Zealand. Further the staples used in the UK have the barbed end mentioned above and the full length of the staple leg is inserted into the post. The UK staples therefore require substantially more force to remove compared to the standard staples in New Zealand.

The known staple remover is inefficient at successfully removing the long, barb ended staples in one piece. This is because more of a leverage force is required on the handle and this in turn provides more force on the wire when it comes into contact with the internal end of the claw portions. As a consequence at the claw regions, the known staple remover bends the wire at two spaced apart points causing a z-shaped bend of the wire. As a result the wire is cut at the contact points and the tool loses its ability to remove the staple by means of the wire. Also, the known staple remover can only be applied to square posts and to remove staples above 200 mm from ground level. Any staples located lower than 200 mm above ground level cannot be removed using the known staple remover due to the orientation of the handle. Further when the tool is used to pull out staples larger than 15 mm long, the claws of the tool bend inwards and are unusable again and unrepairable without great effort. Therefore, in summary, the staple remover as shown in FIG. 1 cannot withstand the required level of force to pull the larger UK staple out of a fence post without causing damage to the known staple remover or the wire.

The present invention is derived from the realisation that there exists the need to provide a more versatile staple remover with the ability to remove staples located in posts by positioning the wire tightly between the claws without cutting or damaging the wire. In particular the staple remover of the invention can remove larger staples having barbed ends faster and easier whilst using less physical force of the user to remove the staple in the process. It also provides a staple remover that can be applied to fences where the wire is positioned further away from the post or where the staple and wire is located close to ground level.

Therefore, the present invention and its embodiments addresses the above described problems and desires.

SUMMARY OF THE INVENTION

According to a first aspect of the invention there is provided a staple removal device for removing a staple and wire arrangement from a fence post, comprising:

a main body comprising a first jaw and a second jaw spaced apart from each other, the first jaw providing a first elongate channel for receiving the wire on one side of the staple and the second jaw for providing a second elongate channel for receiving the wire on a second side of the staple, both the first and second elongate channels having an open end and a closed end forming a contact region with the wire either side of the staple to be removed;

at least one gripping part moveably connected to the main body and moveable relative to at least a portion of the first and second jaw;

a lever configured in mechanical communication with the gripping part and for actuating movement of the gripping part to grip the wire in the first and second channel to remove the staple and wire arrangement; and a block portion configured at a surface of the main body wherein a side edge of the block portion is substantially in alignment with the closed end of the first channel so as to, in use, increase the surface area of the contact region between the staple removal device and the wire. The lever is an elongate member that can be used as a handle that is grasped by the user and to which a user can apply a force causing the device to be used to remove staples from a fence post.

The first claw may be spaced apart from the second claw forming a recessed portion therebetween for receiving the fence post.

The lever may be adapted to be actuated by hand.

The main body may comprise at least a first claw and a second claw for hooking onto the wire each side of the staple. The device may be positioned to hook either above or below the wire, depending on the intended direction of operation. The main body may further comprise a leverage portion for abutting the front surface of the fence post. The leverage portion may be in the form of a plate.

The at least first and second claws may be attached to an end of the leverage portion.

The jaws may be formed of the claw and moveable gripping means.

The at least one wire gripping means may be rotatable about a pivot point between a first position and a second position, wherein in the first position the wire gripping means may be positioned remote from the wire to be gripped and wherein in the second position the wire gripping means may be positioned in contact with the wire to be gripped.

In the first position the lever has yet to be actuated and wherein in the second position the lever has been actuated.

The staple remover may further comprise a return mechanism for automatically returning the at least one wire gripping means to the first position, whenever the lever is not being actuated.

The return mechanism may be a spring-loaded mechanism.

The lever may be directly connected to the wire gripping means. The wire gripping means may comprise a pair of arms.

In the second position, the edge of the at least one gripping member may remain spaced apart from surface of the claws so as not to crush the wire.

The device may further comprise a strut member arranged between the first claw and the second claw for providing increased strength to the device.

In use, the lever may extend at an acute angle with respect to the vertical axis of the fence on which it is used wherein the end of the lever is at an initial vertical height and on actuation of the device the lever may be moved in either a clockwise or anticlockwise motion by the user resulting in the end of the lever moving below or above the initial vertical height respectively.

A staple remover wherein the jaws may be adapted to hook over the top of the wire.

Whilst the invention has been disclosed above it extends to any inventive combination of the features set out above, or in the following description, drawings or claims.

BRIEF DESCRIPTION OF THE DRAWINGS

The invention will now be described, by way of example only, with reference to the accompanying drawings in which.

DETAILED DESCRIPTION

Figure 1:
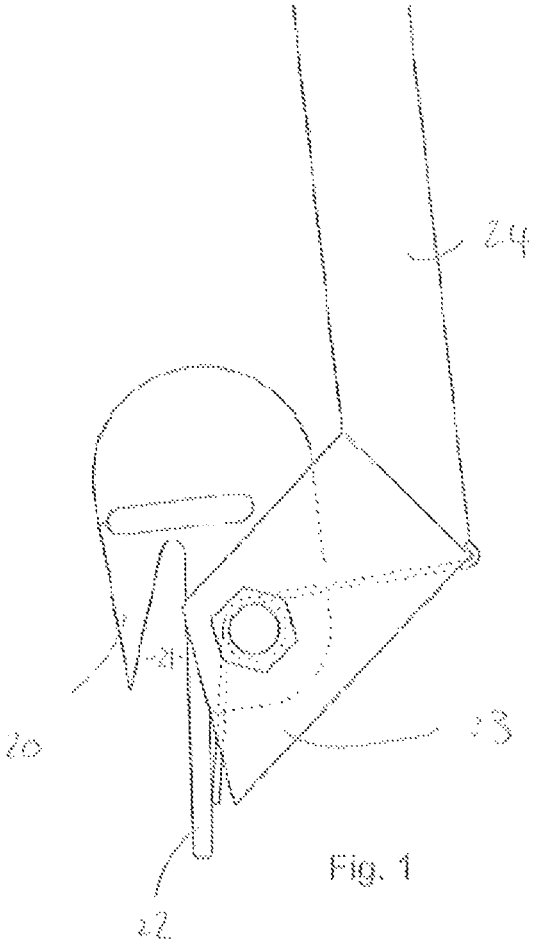
FIG. 1 is a side view of a known staple remover.
Figure 2:
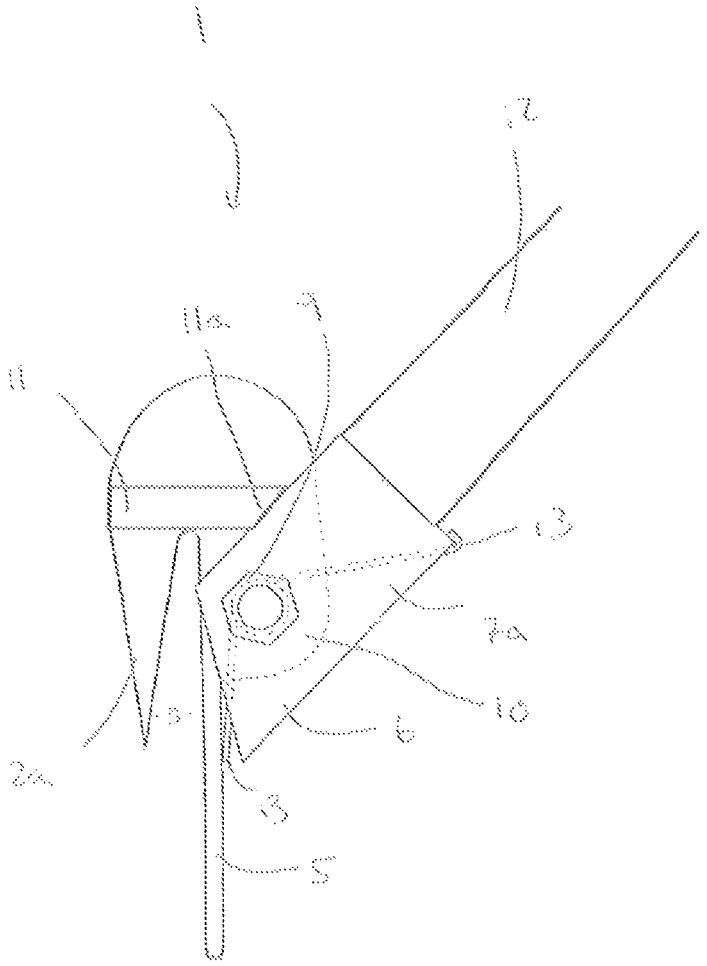
FIG. 2 is a side view of the staple remover according to the invention with the handle of the staple remover in a first orientation.
Figure 3:
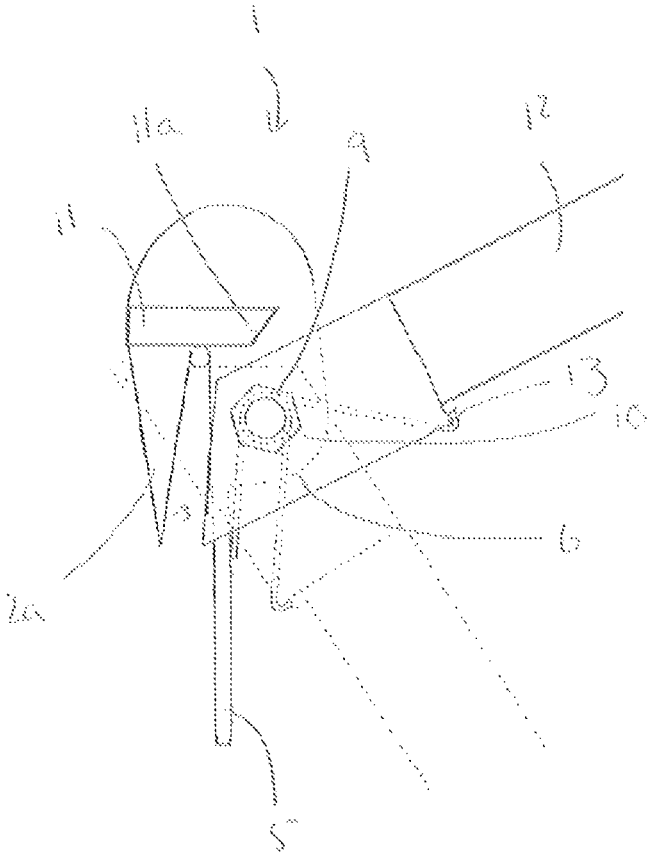
FIG. 3 is a side view of the staple remover according to the invention with the handle of the staple remover in a second orientation.

FIG. 2 and FIG. 3 shows the staple remover 1 comprising a first claw 2*a* and a second claw 2*b* which are adapted to hook onto a wire either side of a staple.

In use the claws 2*a*, 2*b* are positioned either side of the post such that the front of the post fits in the region located between the first and second claw 2*a*, 2*b*. Each claw includes a channel 3 in which the wire is located wherein each channel 3 has an open end past which the wire passes as the claws 2*a*, 2*b* are being hooked onto and over the wire, and a closed end where the wire is retained after the claws 2*a*, 2*b* have been hooked over the wire.

Figure 4:
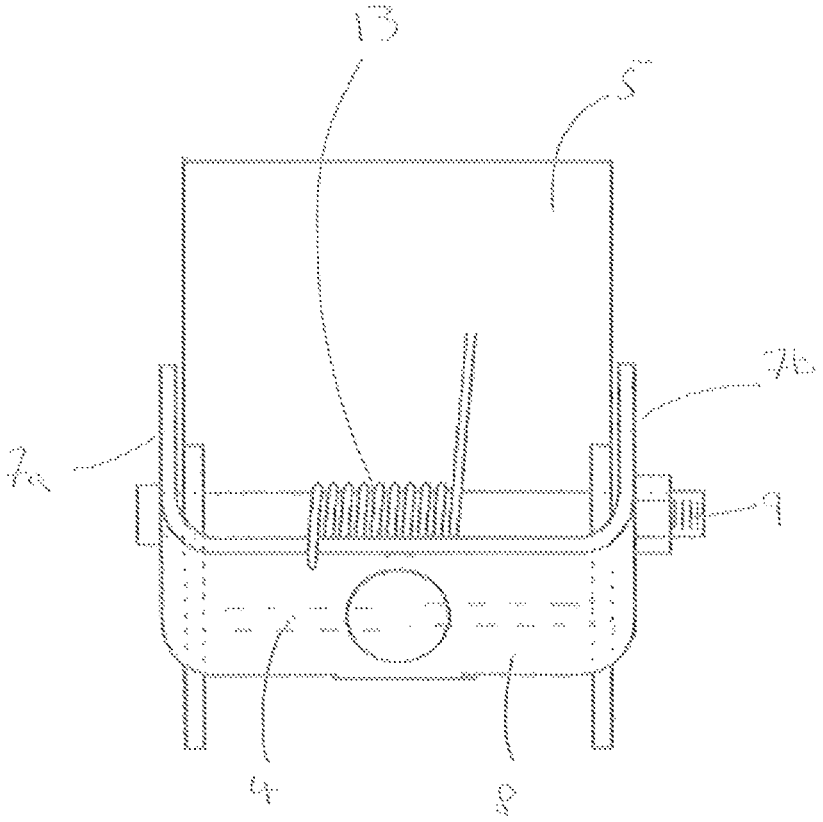
FIG. 4 is a rear view of the staple remover.

FIG. 4 shows a support bar 4 positioned intermediate the first and second claw 2*a*, 2*b* such that it extends between the inner surface of the first claw 2*a* to the inner surface of the second claw 2*b*. The support bar 4 braces the first and second claw 2*a*, 2*b* apart so that they cannot be bent when applied to large staples.

The staple remover 1 also includes a leverage portion 5 in the form of a leverage plate. The leverage plate extends from the claws and when the claws have been hooked over the wire, the leverage plate 5 extends downwardly from the claws and in contact with the post.

A wire gripping means 6 in the form of a pair of arms 7*a*, 7*b* joined by a cross-member 8 is provided. The arms 7*a*, 7*b* are rotatable about a pivot point which is in the form of a bolt 9 which passes through each of the arms as well as the lower portions 10 of the claw. The lever 5 is connected at one end directly to the arms via the cross-member 8. The arms 7*a*, 7*b* are rotatable about the pivot point from a first position as indicated in FIG. 2 to a second position as indicated in FIG. 3.

A block 11 is provided on the outer surface of the first and second claw 2*a*, 2*b*. The block 11 is substantially rectangular with a chamfered end 11*a*. The lower side edge of each block 11, 11' is aligned with the closed end 3*a* of the channel 3 of the respective claws 2*a*, 2*b* i.e. the terminating end of the channel 3. Therefore a point in the elongate edge of the block and the closed end of the claw channel 3 are flush. This prevents the closed end 3*a* of the hook channel 3 from cutting the wire which would prevent the staple from being pulled out as desired. By making the block 11 flush with the hook or claw edge, there is no gap between the edge of the block 11 and the closed end 3*a* of the claw 2 and therefore no cutting edge is provided. The blocks 11, 11' provide an increased surface area to the part of the device that comes into contact with the wire, therefore the force is applied to a greater surface area and not just to a small area located at the closed end 3*a* of the claw channel 3. This means that the z shaped bending of the wires is minimised and the wires at the first and second claw 2*a*, 2*b* are gripped tightly, but not over-bent at two points.

The block 11 is designed so that chamfered edge 11*a* permits rotation of the gripping member 6 and when the edge of the arm 7*a* of the gripping member 6 comes into contact with a portion of the block 11 the arm 7*a* is prohibited from coming into contact with the claw 2*a* thereby preventing it from crushing or cutting the wire, but allowing it to tightly squeeze the wire so as to enable the staple to be pulled out.

In use the staple remover 1 is hooked onto and over the top of the wire, with the claws 2*a*, 2*b* being located on each side of the staple, and on each side of the post. Once the claws 2*a*, 2*b* have been hooked onto the wire, the wire is placed within the channel 3 and is positioned up against the closed end 3*a* of the channel 3 and in contact with the side edge of the block 11 preventing all the pressure on the wire being applied to the closed end 3*a* of the channel only.

Therefore, the force applied by the user to remove the staple from the post is also applied to the part of the block 11 in which the wire comes into contact with thereby increasing the surface area on which the force is applied.

The front of the post fits within the space formed by the claws 2*a*, 2*b* and the leverage plate 5.

The handle 12 of the device is directly connected to the gripping member 6, e.g. is welded to the cross-member 8 and is arranged to extend from the gripping member 6 at an acute angle, for example 45 degrees with respect to the vertical axis of the fence to which it is applied. This means that the end of the handle 12 is at an initial vertical height. On actuation of the device 1, the handle 12 is moved in a downwardly direction towards the ground by the user resulting in the end of the handle 12 moving below the initial vertical height.

The user applies a downward force to actuate the handle 12 so as to cause the arms 7*a*, 7*b* to rotate about the pivot point until the arms are brought into contact with the wire so as to clamp onto it. In this position as shown by the dotted line of FIG. 3, the arms 7*a*, 7*b* are in the second position.

Figure 5:
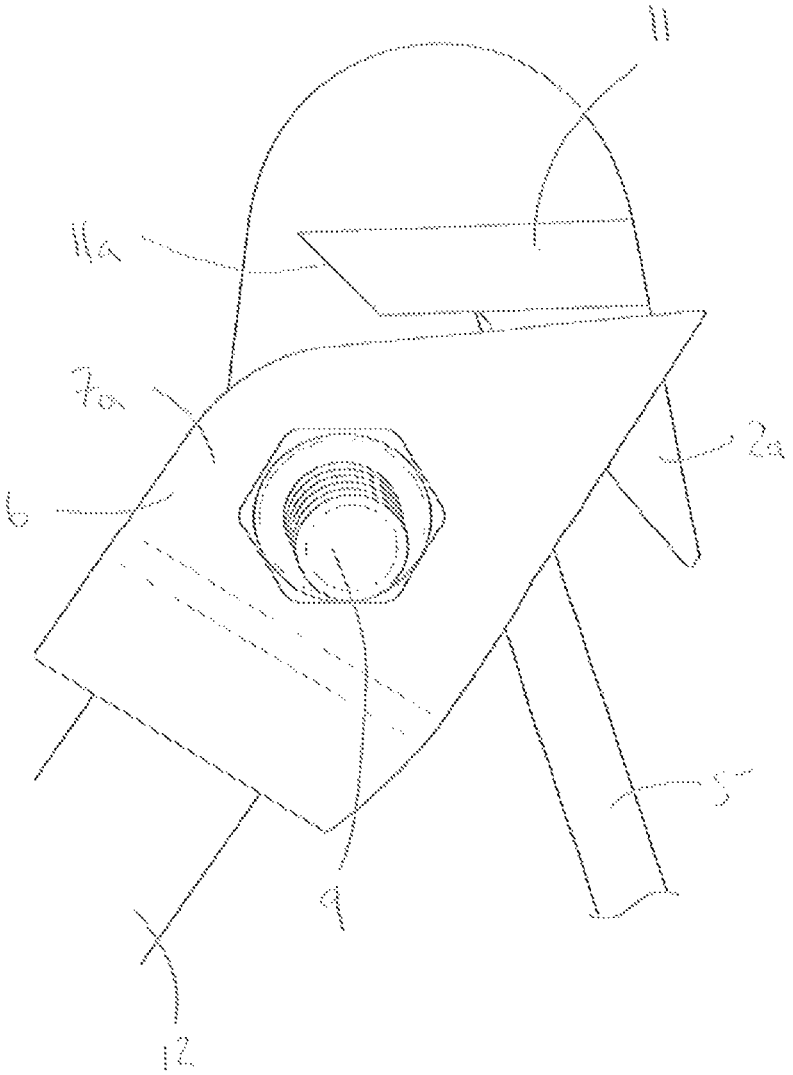
FIG. 5 is a side view of the staple remover used in a second orientation.

Once the arms 7*a*, 7*b* are gripping the wire, no further rotation of the arms is possible. Therefore a gap between the inner surface of the gripping member and the closed end of the chamber is maintained as shown in FIG. 5. Therefore further actuation of the handle 12 causes the staple remover to pivot about the leverage plate 5 whilst the wire remains firmly clamped or squeezed between the arms (but no over-squeezed). Therefore, the wire is squeezed between the combined surface of the aligned blocks 11 and closed end 3*a* of the channel 3 and the gripping member 6, which then pulls the staple out without cutting the wire.

This results in the claws 2*a*, 2*b* pulling firmly against the wire and it is this action or pressure which forces the staple out of the front of the post. Therefore it is the pressure of the wire which results in the wire pulling the staple out of the post.

Figure 6:
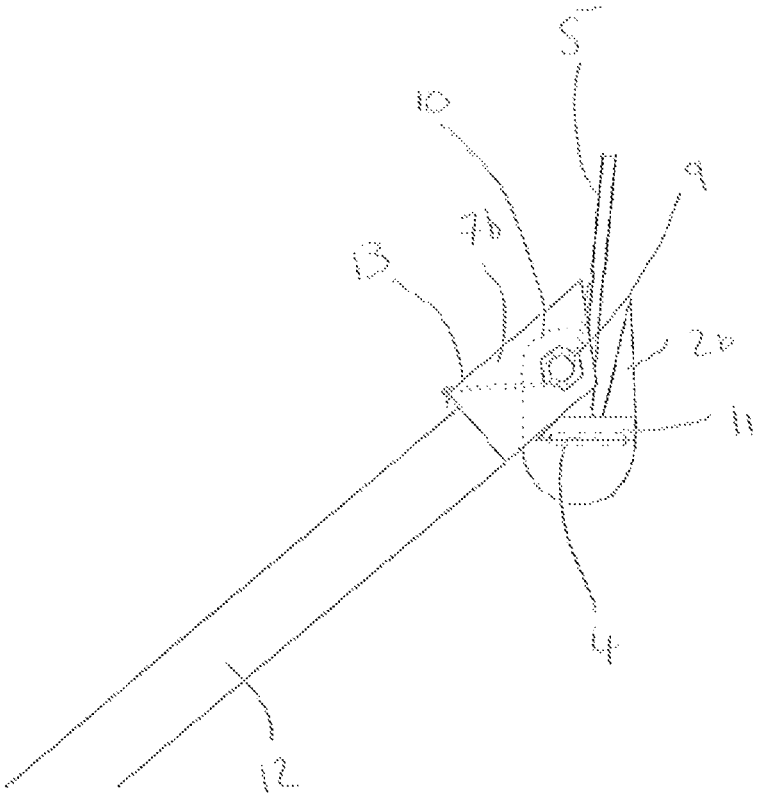
FIG. 6 is a side view of the staple remover in a closed configuration.

The relative arrangement of the handle 12 and the gripping member enables the wire to be hooked on either direction of the wires i.e. from above or from below (as shown in FIG. 6) with ease allowing the user to hook a wire that is only 30 mm above ground level. However, in this application the handle 12 must be moved in an upwardly direction and on actuation of the handle 12 the end of the handle will be positioned above the initial vertical position, without closing the jaws against the blocks, letting you pull the handle 12 up towards the air and pull the staple out easily.

The claws 2*a*, 2*b* and the pivot plate 5 are elongate so as increase the amount of leverage allowing longer staples to be pulled out easier and to pull the staple further away from the posts. The elongate plate 5 also ensures that the rotating action pulls the staple completely out of the post.

Once the staple and the wire are removed from the post, the staple remover 1 may then be used for removing the next staple and wire from the front of the post. The leverage portion 5 effectively acts as a fulcrum, about which the staple remover 1, as a whole, pivots—upon secondary actuation of the lever.

The staple remover 1 also includes a return mechanism in the form of a spring 13. The spring 13 is configured so that the arms are automatically returned to the first position, unless the handle 12 is being actuated.

Once the staple remover 1 has been used to remove a staple and wire arrangement from the post, the spring 13 returns the arms 7*a*, 7*b* to the first position so that the staple remover 1 is automatically ready to remove the next staple and wire arrangement from the same or next post.

The parts of the staple remover 1 may be made from light, yet, strong material such as aluminium or steel.

The size of the staple remover 1 makes it easily transportable and stored, for example within a toolbox or leather fencing apron.

The staple remover 1 can pull staples out of posts up to 50 mm long without damage to the staple remover or wire. This is enabled by the support bar and the strength and positioning of the blocks 11, 11'.

Therefore by modifying the way the blocks 11, 11' and gripping member 6 work together there is provided a staple remover 1 that is more versatile, efficient and reliable at hooking onto wires and removing staples, including long staples having barbed ends, from a broader range of fence posts. The inclusion of the support bar 4 also prevents bending of the claws 2*a,* 2*b* and as such provides a stronger staple remover 1.

Various modifications to the principles described above would suggest themselves to the skilled person. For example, whilst the staple remover 1 has been described as being used to remove staples from posts, it is just as useful to be applied to square intermediate fence posts, or other types of fence posts made of other materials and that have different shapes and sizes.

When the staple remover 1 is to be used on larger fence posts, the claws 2*a,* 2*b* are not able to be positioned each side of the front of the post, due to the width or diameter of the fence post being greater than the distance between the first claw and the second claw. Therefore in this instance there is an additional step of forcing the claws down over the wire on either side of the staple.

Further where there are two staples in the same wire in the same post, there is no gap between the post, the user must make a gap by hitting the claws 2*a,* 2*b* between the wire and the post to be able to hook onto the wire. The elongate claws help this process. The claws 2*a,* 2*b* are configured to be longer in length compared to the claws 2*a,* 2*b* of the known staple remover in New Zealand.

As mentioned above the device 1 may be hooked onto the wire from above as shown in FIG. 5 or below the wire depending on the distance of the staple and wire arrangement from the ground.

A staple and wire arrangement means where a staple is provided to secure a wire to a fence post.

The invention claimed is:

1. A staple removal device for removing a staple and wire arrangement from a fence post, comprising:

a main body comprising a first jaw and a second jaw spaced apart from each other, the first jaw providing a first elongate channel for receiving the wire on one side of the staple and the second jaw for providing a second elongate channel for receiving the wire on a second side of the staple, both the first and second elongate channels having a closed end forming a contact region with the wire either side of the staple to be removed;

at least one gripping member moveably connected to the main body and moveable relative to the first and second jaw;

a lever configured in mechanical communication with the gripping member and for actuating movement of the gripping member to clamp the wire against the closed ends to cause removal of the staple and wire arrangement;

and a block portion configured at a surface of the main body wherein a side edge of the block portion is substantially in alignment with the closed end of the first channel so as to, in use, increase the surface area of the contact region between the staple removal device and the wire.

2. The device of claim 1, further comprising a further block portion configured substantially in alignment with the closed end of the second channel.

3. The device of claim 1, wherein the main body comprises at least a first claw and a second claw for hooking onto the wire each side of the staple.

4. The device of claim 1, wherein the main body further comprises a leverage portion for abutting the front surface of the fence post.

5. The device of claim 4, when dependent on any of claim 2 or claim 3, wherein the at least first and second claw are attached to an end of the leverage portion.

6. The device of claim 3, wherein the jaws are formed of the claw and the leverage portion.

7. The device of claim 1, wherein the at least one wire gripping means is rotatable about a pivot point between a first position and a second position, wherein in the first position the wire gripping means is remote from the wire to be gripped and wherein in the second position the wire gripping means is in contact with the wire to be gripped.

8. The device of claim 7, wherein when the wire gripping means is in the first position the lever has yet to be actuated and wherein when the wire gripping means in the second position the lever has been actuated.

9. The device of claim 7, further comprising a return mechanism remover further comprises a return mechanism for automatically returning the at least one wire gripping means to the first position, whenever the lever is not being actuated.

10. The device of claim 9, wherein the return mechanism is a spring-loaded mechanism.

11. The device of claim 7, wherein in the second position, a contact edge of the at least one gripping member remains spaced apart from the surface of the claws so as not to crush the wire.

12. The device of claim 1, wherein the wire gripping member comprises a pair of arms.

13. The device of claim 3, further comprising a support member arranged between the first claw and the second claw for providing increased strength to the device.

14. The device of claim 1, wherein the lever is directly connected to the gripping member.

15. The device of claim 1, wherein, in use, the lever extends from the gripping member at an acute angle with respect to the vertical axis of the fence on which it is to be used, wherein the end of the lever is at an initial vertical height and on actuation of the device the lever is moved in either a clockwise or anticlockwise motion by the user resulting in the end of the lever moving below or above the initial vertical height respectively.

* * * * *